US008441894B2

(12) United States Patent
Wenzel

(10) Patent No.: US 8,441,894 B2
(45) Date of Patent: May 14, 2013

(54) WATCH

(75) Inventor: Jan Wenzel, Altenberg (DE)

(73) Assignee: Lange Uhren GmbH, Glashhutte (DE)

( * ) Notice: Subject to any disclaimer, the term of this patent is extended or adjusted under 35 U.S.C. 154(b) by 192 days.

(21) Appl. No.: 12/984,798

(22) Filed: Jan. 5, 2011

(65) Prior Publication Data

US 2011/0164475 A1 Jul. 7, 2011

(30) Foreign Application Priority Data

Jan. 5, 2010 (DE) ..... 10 2010 000 696
Jan. 8, 2010 (DE) ..... 10 2010 000 749

(51) Int. Cl.
*G04B 19/32* (2006.01)

(52) U.S. Cl.
USPC ..... 368/226; 368/67; 368/234

(58) Field of Classification Search ..... 368/67, 368/223, 226, 227, 232–234
See application file for complete search history.

(56) References Cited

U.S. PATENT DOCUMENTS

| | | | | |
|---|---|---|---|---|
| 4,276,633 | A * | 6/1981 | Takami et al. | 368/227 |
| 4,285,055 | A * | 8/1981 | Takami et al. | 368/226 |
| 5,714,012 | A | 2/1998 | Murata et al. | |
| 5,838,640 | A | 11/1998 | Sonoda et al. | |
| 5,984,485 | A * | 11/1999 | Poli et al. | 362/26 |
| 6,452,089 | B1 * | 9/2002 | Kubota | 136/251 |
| 6,538,959 | B1 | 3/2003 | Yamaguchi et al. | |
| 6,806,644 | B2 * | 10/2004 | Ueno et al. | 313/512 |
| 7,136,138 | B1 * | 11/2006 | Sekiguchi et al. | 349/162 |
| 7,242,641 | B2 | 7/2007 | Sato et al. | |
| 7,366,059 | B2 | 4/2008 | Seyr | |
| 7,889,602 | B2 * | 2/2011 | Behling et al. | 368/10 |
| 8,243,556 | B2 * | 8/2012 | Yamaguchi et al. | 368/205 |
| 2004/0170088 | A1 | 9/2004 | Seyr | |
| 2005/0018545 | A1 | 1/2005 | Seyr | |
| 2009/0129210 | A1 | 5/2009 | Yamaguchi et al. | |

FOREIGN PATENT DOCUMENTS

| | | |
|---|---|---|
| CH | 308319 | 7/1955 |
| CN | 101116038 | 1/2008 |
| DE | 698 12 613 | 2/2004 |
| EP | 1 331 529 | 7/2003 |
| EP | 1 843 226 | 10/2007 |
| EP | 1 852 754 | 11/2007 |
| WO | WO 03/042764 | 5/2003 |

OTHER PUBLICATIONS

Produktinformation 50026 Lumilux Effekt Grun N-L, 2006, URL: http://www51.honeywell.com/sm/lumilux/de/common/documents/Spie-N-L.pdf [abgerufen am Sep. 24, 2010].

* cited by examiner

*Primary Examiner* — Sean Kayes
(74) *Attorney, Agent, or Firm* — Cozen O'Connor

(57) ABSTRACT

A watch, in particular a wristwatch, having a watch case that has a viewing opening oriented towards an observer, a movement, and one or more components with light-receiving regions on their surfaces. The movement and the components with regions of light-receiving surface are arranged in the watch case and are covered by a light-transmissive covering part in the direction of the observer. The covering part is transmissive for ultraviolet light and is at least largely opaque for light in the visible spectrum.

15 Claims, 3 Drawing Sheets

WATCH

BACKGROUND OF THE INVENTION

1. Field of the Invention

The invention relates to a watch, in particular a wristwatch, having a watch case that has a viewing opening oriented towards an observer, a movement, and one or more components with light-receiving regions on their surfaces, wherein the movement and the components with regions of light-receiving surface are arranged in the watch case and are covered by a light-transmissive covering part in the direction of the observer.

2. Description of the Related Art

In a watch, which is powered by a solar battery, it is known to form the covering part from a ceramic that is transmissive for light that strikes it, such that a solar battery arranged behind the covering part can be charged. In this case, the covering part is also transmissive for the light that is visible to people.

This leads to the fact that the light that has passed through the covering part on its side facing away from an observer can be reflected off components located behind the covering disc and passes back through the covering part to the observer side, illuminating the covering part.

SUMMARY OF THE INVENTION

An object of the invention is to create a watch of the type mentioned initially, in which light can be supplied easily from the outside through the covering part to the components with light-receiving regions, with the illumination of the covering part that can be seen by a person being at least largely avoided.

This object is achieved according to one embodiment of the invention in that the covering part is transmissive for ultraviolet light and is at least largely opaque for light in the visible spectrum.

As a result of this configuration, ultraviolet light passes through the covering part to the light-receiving regions behind the covering part without significant attenuation and thus with high intensity of its light irradiation.

Since the light having a spectrum visible to people is already prevented from passing through the covering part from the outside to the inside of the watch case, the covering part cannot be illuminated by light having a spectrum visible to people and reflected inside the watch case.

The regions of light-receiving surface can have different forms depending on the purpose thereof.

Thus it is possible for the surfaces to be parts of solar batteries.

If the regions of light-receiving surface comprise of a luminous substance having a long afterglow, in particular of phosphorescent pigments, then the luminous substance is activated by the ultraviolet light components of the daylight or artificial light passing through the covering part from the outside and leads to an afterglow with a high luminance.

This afterglow can then be used for lighting purposes in the case of darkness or when exposure to external light is no longer occurring.

Production is simple and cost-effective when the covering part comprising of a plate-like support part which is made of a light-transmissive material and to which one or more coatings are applied, said coatings being transmissive for ultraviolet light and at least largely opaque for light in the visible spectrum.

In one embodiment, the coatings preferably applied on the observer side to the support part are applied in a wide variety of ways to the support part made of light-transmissive material. Advantageous possibilities for this purpose are, for example, vapour deposition, sputtering or printing.

In one embodiment, the support part consists of any suitable material.

Preferably, the support part of the covering part consists of glass, in particular sapphire glass.

If at least one of the coatings consists of silver or contains a silver fraction, a high-contrast covering part with a dark colouration is obtained.

If at least one of the coatings consists of titanium oxide or contains a titanium oxide fraction, the covering part obtains not only a contrast-rich, dark colouration but also additionally has an antireflective effect.

In order to achieve sufficient opacity for light of the spectrum visible to people, the coating of titanium oxide has a thickness of between 65 nm and 100 nm.

Preferably, the coating of titanium oxide has a thickness of between 75 nm and 90 nm, in particular of 80 nm.

The covering part can be transmissive for any wavelength range of the ultraviolet light spectrum.

It is advantageous in this case if the absorption curve of the phosphorescent pigments has an absorption peak that lies in the wavelength range, in particular approximately in the middle of the wavelength range, for which the covering part is transmissive for the light of the ultraviolet spectrum.

Preferably, the covering part is transmissive for ultraviolet light having a wavelength of between 250 nm and 430 nm. This is advantageous in particular when the absorption curve of the phosphorescent pigments has an absorption peak at a wavelength close to 370 nm.

Furthermore, this wavelength range is far enough from the light spectrum visible to people that passing-through of this light is avoided.

If the covering part has one or more continuous windows and the components with the light-receiving regions are support elements that can be driven movably by the movement and the light-receiving regions are display elements which, in a rhythm determined by the drive of the movement, pass into the region of the windows and are visible to the observer through said windows, then the display elements are exposed to ultraviolet light not only while they are positioned in the region of the windows but also when they are covered by the covering part, and so in the case of daylight or artificial light, the luminous substance having a long afterglow, which consists in particular of inorganic phosphorescent pigments, is always excited to a sufficiently high degree.

In the case of darkness, the display elements then have a long afterglow with a high luminance.

The covering part can in one embodiment form a dial of the watch.

The display elements can be number and/or numeral and/or letter and/or symbol discs and/or rings, by which the time and/or the date and/or the day of the week and/or the month can be displayed digitally.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

An exemplary embodiment of the invention is described in more detail below and is illustrated in the drawings, in which.

DETAILED DESCRIPTION OF THE PRESENTLY PREFERRED EMBODIMENTS

Figure 1:
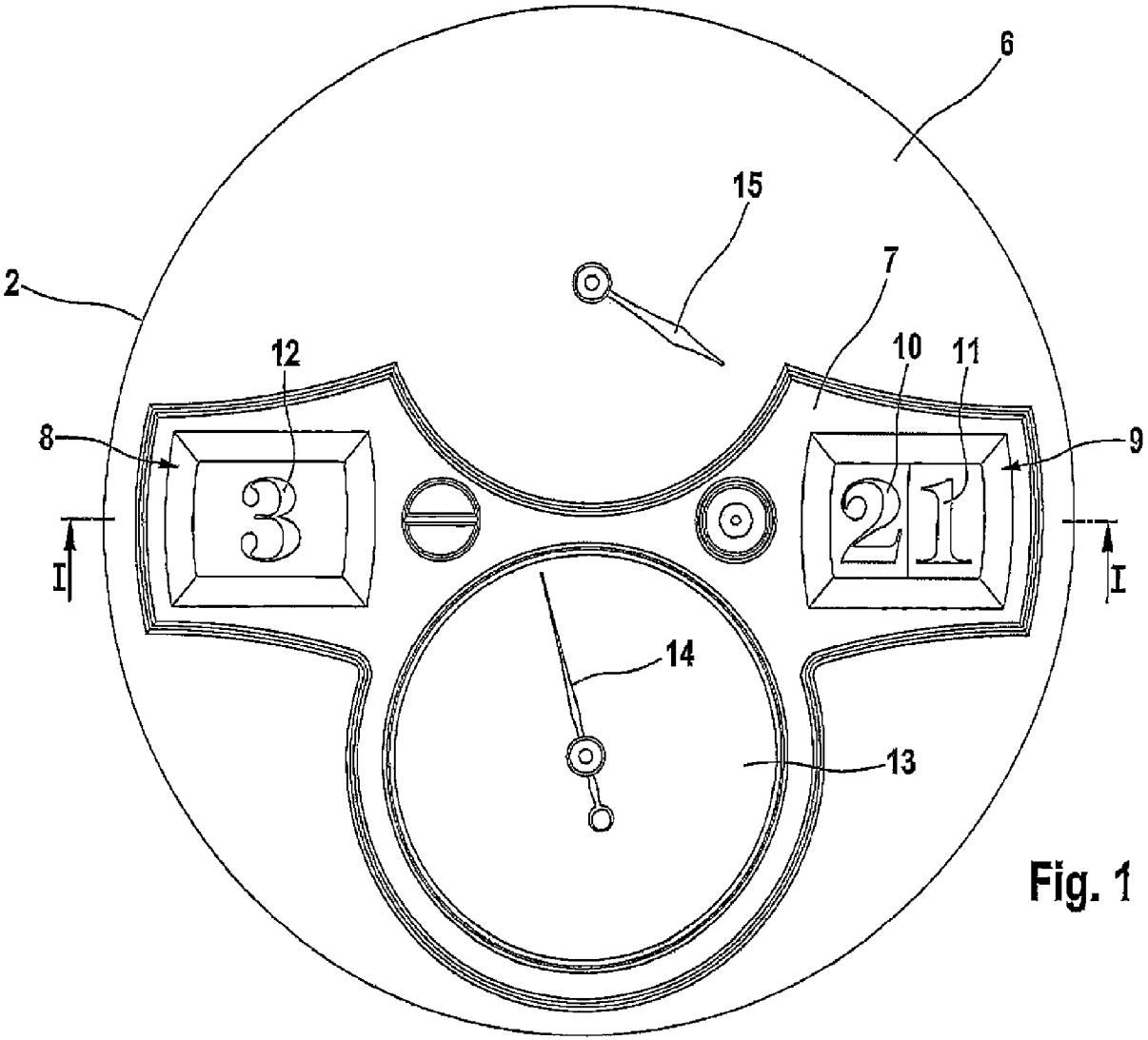
FIG. 1 is a plan view of a watch.
Figure 2:
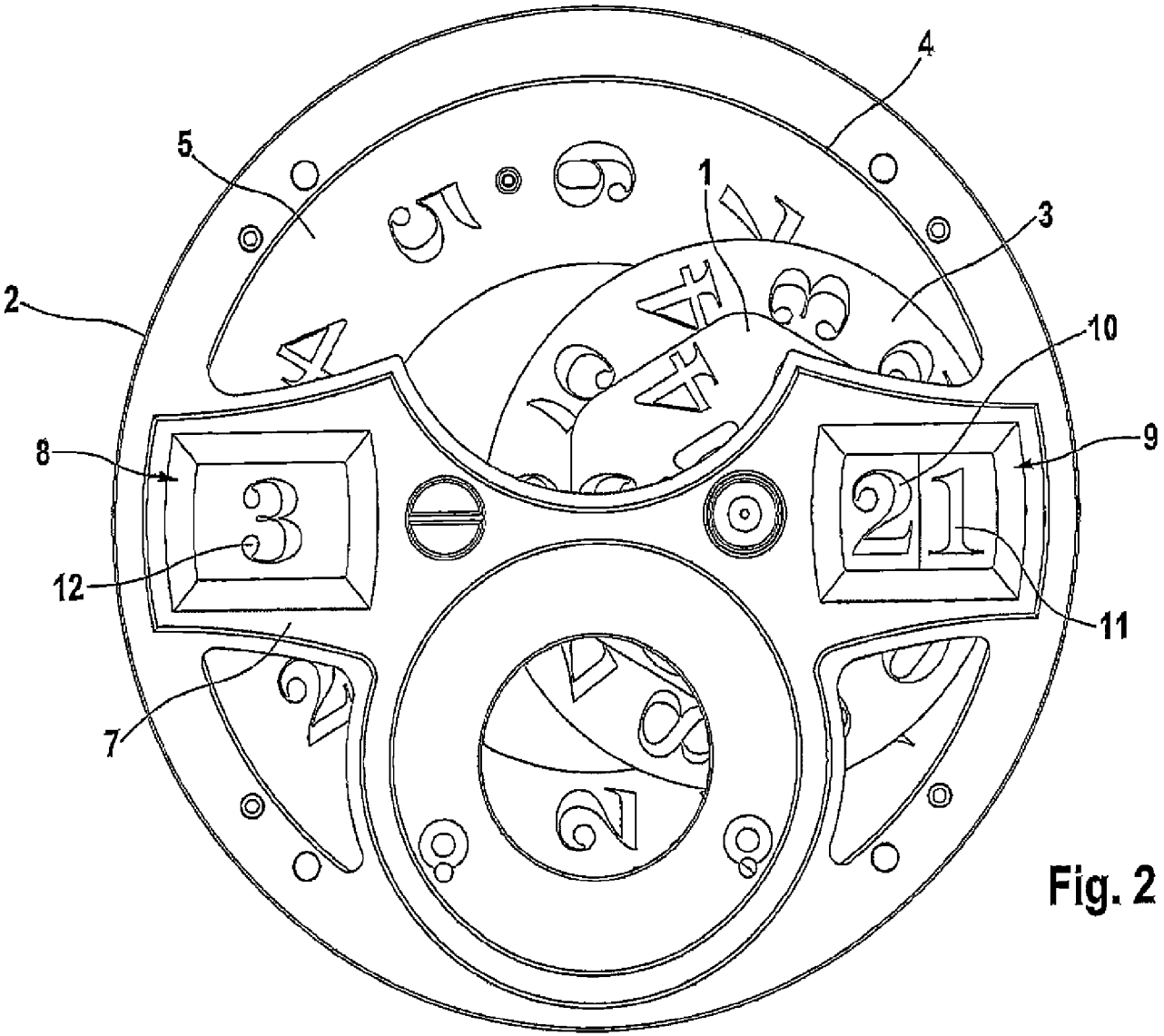
FIG. 2 shows a plan view of the watch according to FIG. 1 with the dial removed.
Figure 3:
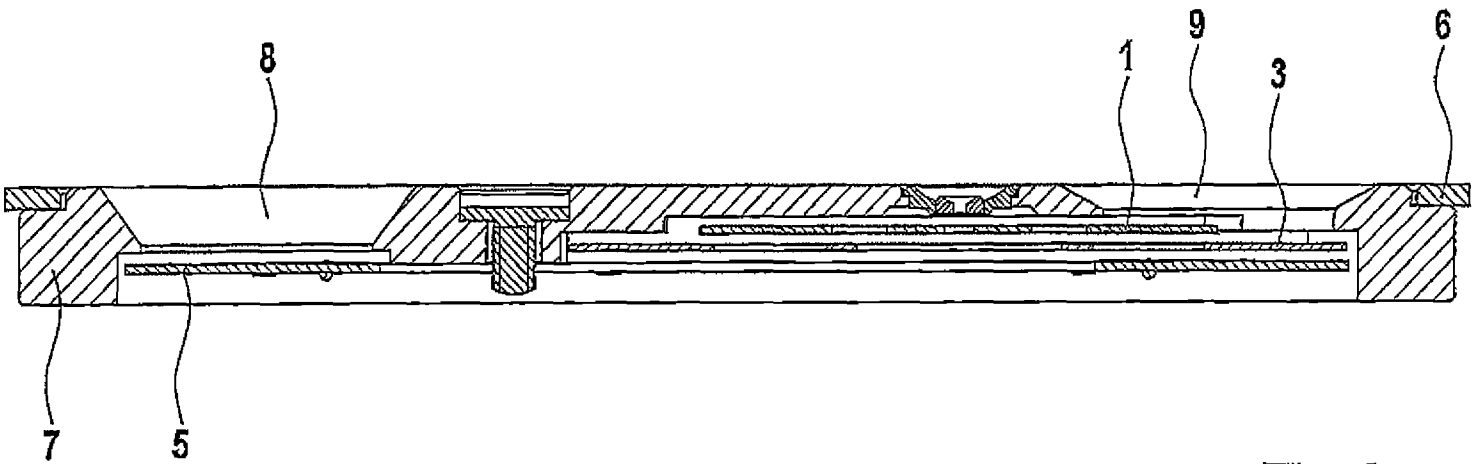
FIG. 3 shows a section along the line 3-3 in FIG. 1 of the region of display discs and time bridge of the watch according to FIG. 1.

The watch is a wristwatch having a plurality of numeral discs 1, 3, 5 for the digital display of the time. (FIGS. 2 and 3)

In this case, a tens disc 1 is arranged in a pot-like watch case 2 and parallel to and in front of a units disc 3.

The tens disc 1 and the units disc 3 are arranged coaxially with one another, and within outer contour 4 of an annular hours disc 5, which is located on a plane parallel to the tens disc 1 and the units disc 3.

In a manner distributed evenly around the circumference, the tens 10, namely 0 to 5, are arranged on the tens disc 1, the units 11, namely 0 to 9, are arranged on the units disc 3 and the hours 12, namely 1 to 12, are arranged on the hours disc 5.

These numerals 10, 11, 12 form light-receiving and light-emitting regions of a luminous substance having a long afterglow. This luminous substance consists preferably of phosphorescent inorganic pigments.

The dial 6 itself consists of a transparent support part made of sapphire glass, the observer-side surface of which is provided by vapour deposition with a coating of titanium dioxide in a thickness of 80 nm.

As a result, the dial 6 is transmissive for ultraviolet light in a wavelength of between 250 nm and 430 nm, but is opaque for light in the spectrum visible to people.

Thus, the dial 6 is opaque to a person. Therefore, an observer cannot see from the observer side the components of the watch that are located behind the dial 6, in particular the numeral discs 1, 3 and 5.

Two windows 8 and 9 are formed diametrically opposite one another in the time bridge 7.

Through the first window 8, the hour 12, which is located in each case under said first window, on the hours disc 5 can be seen and through the second window 9, the tens 10 and units 11, which are located in each case under said second window 9, on the tens disc 1 and the units disc 3 can be seen.

The time is displayed by these visible numerals. In the present case, the time is 3:21.

Since the dial 6 is transmissive for ultraviolet light, the tens 10, units 11 and hours 12 are exposed to ultraviolet light not only when they are currently in the region of one of the windows 8 or 9, but also when they are located in a region covered by the dial 6.

Thus, the luminous substance having a long afterglow, the absorption curve of which preferably has an absorption peak at a wavelength close to 370 nm, is also charged in these positions covered by the dial 6, and said luminous substance also has a very long afterglow in darkness.

Furthermore formed in the time bridge 7 is a round clearance into which there is inserted a scale disc 13 of a circular seconds display over which there passes a second hand 14, which can be driven in a rotatable manner.

Above the time bridge 7, a pin of a power reserve indicator 15, which can be driven in a rotatable manner, of a power reserve display protrudes through an opening in the dial 6.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A watch, comprising:

a watch case having at least one viewing opening oriented towards an observer;

a movement arranged in the case;

at least one component having a light-receiving region on a surface arranged in the watch case oriented towards the observer; and a light-transmissive covering part in the direction of the observer that is transmissive for ultraviolet light and is at least largely opaque for light in the visible spectrum, the light-transmissive covering part arranged to cover the movement and the at least one component.

2. The watch according to claim 1, wherein the light-receiving region comprises a luminous substance having a long afterglow.

3. The watch according to one of claim 2, wherein the covering part comprises:

at least one window, wherein the at least one component with the light-receiving is configured to be driven movably by the movement and the light-receiving regions are display elements which, in a rhythm determined by the drive of the movement, pass into a region of the at least one window and are visible to the observer through the window.

4. The watch according to claim 3, wherein the display elements are one or more of numbers, numerals, letters, symbol discs, and rings.

5. The watch according claim 1, wherein the covering part is transmissive for ultraviolet light having a wavelength of between 250 nm and 430 nm.

6. The watch according to claim 1, wherein the watch is a wristwatch.

7. The watch according to claim 1, wherein the covering part comprises a plate-like support part comprising:

a light-transmissive material; and at least one coating applied to the light-transmissive material, the at least one coating being transmissive for ultraviolet light and substantially opaque for light in the visible spectrum.

8. The watch according to either of claims 7, wherein the at least one coating comprises at least one of silver and contains a silver fraction.

9. The watch according to one of claims 7, wherein the at least one coating comprises at least one of titanium oxide and contains a titanium oxide fraction.

10. The watch according to claim 9, wherein the titanium oxide has a thickness of between 65 nm and 100 nm.

11. The watch according to claim 7, wherein the support part of the covering part comprises glass.

12. The watch according to claim 11, wherein the at least one coating comprises at least one of silver, contains a silver fraction, titanium oxide, and contains a titanium oxide fraction.

13. The watch according claim 12, wherein the covering part is transmissive for ultraviolet light having a wavelength of between 250 nm and 430 nm.

14. The watch according to one of claim 13, wherein the covering part comprises at least one window and wherein the at least one component with the light-receiving is configured to be driven movably by the movement and the light-receiving regions are display elements which, in a rhythm determined by the drive of the movement, pass into a region of the at least one window and are visible to the observer through said window.

15. The watch according to claim 14, wherein the display elements are one or more of numbers, numerals, letters, symbol discs, and rings.

* * * * *